US006045423A

United States Patent [19]

Silvia

[11] Patent Number: 6,045,423

[45] Date of Patent: Apr. 4, 2000

[54] POOL CHAIR

[76] Inventor: George Silvia, 18 Seacrest Ave., Somerset, Mass. 02726

[21] Appl. No.: 09/157,059

[22] Filed: Sep. 18, 1998

Related U.S. Application Data

[60] Provisional application No. 60/060,282, Sep. 22, 1997.

[51] Int. Cl.[7] ..... B63C 9/08

[52] U.S. Cl. ..... 441/132; 441/130

[58] Field of Search ..... 114/303; 440/35, 440/43; 441/129, 132, 130; 297/229

[56] References Cited

U.S. PATENT DOCUMENTS

| | | | |
|---|---|---|---|
| 3,727,249 | 4/1973 | Bonthelius | 9/312 |
| 3,984,888 | 10/1976 | DeLano | 9/347 |
| 4,662,852 | 5/1987 | Schneider et al. | 441/132 |
| 4,877,288 | 10/1989 | Lee | 297/229 |
| 4,986,781 | 1/1991 | Smith | 441/130 |
| 5,004,296 | 4/1991 | Ziegenfuss | 297/194 |
| 5,678,890 | 10/1997 | Tenbroeck | 297/271.6 |
| 5,885,123 | 3/1999 | Clifford | 441/129 |

*Primary Examiner*—S. Joseph Morano
*Assistant Examiner*—Patrick Muldoon
*Attorney, Agent, or Firm*—Robert J. Doherty

[57] ABSTRACT

A floating chair including a generally U-shaped float portion with arms and a base wall which define an opening into which a longitudinally oriented primary body portion having an upper backrest portion, a middle sling portion and a forward footrest portion is positioned to support the human body while the chair floats on the surface of water and further structured to easily fold to a compact flat storage position.

3 Claims, 11 Drawing Sheets

POOL CHAIR

Reference is made to applicant's Provisional Application Serial No. 60/060,282 filed Sep. 22, 1997.

FIELD OF THE INVENTION

This invention relates to pool chairs, that is, chairs that are primarily constructed to float in water and support the human body in a reclining position. Generally, such chairs are utilized in backyard pools although their utility is not so limited.

BACKGROUND OF THE INVENTION

A number of such pool chairs are known and can take the form of articles which can be inflated to supply the buoyancy or articles which include the presence of a buoyant float member normally constructed of some foam resinous material and into which a chair or other support mechanism is built or otherwise incorporated. U.S. Pat. Nos. 4,905,332 and 5,186,667 are examples of the inflatable-type supports while U.S. Pat. Nos. 4,662,852 and 3,117,327 are examples of this latter type construction. Other type constructions of a hybrid nature are known in which some type of frame or guide structure is utilized to support a chair or floating lounge in which the support portions for the human body are formed from buoyant material themselves, and examples of such devices are shown in U.S. Patent Nos. 3,984,888, 5,004,296 and 5,324,221. Despite the presence of the various devices shown in the aforementioned patents, the need still exists for a floating chair which will support the human body in a comfortable and self-adjusting manner and one which is easy to store, transport and utilize and particularly one which is easy to enter and exit while in a floating position within a pool or other body of water.

These and other objects of the present invention are accomplished by providing a pool chair having two separable components including a float portion and a primary body support portion flexibly and articulately mounted within the float portion such that the main portions of the human body are supported by the primary body support portion and secondary support of the human body is achieved by the float portion and that the two portions together form a natural, self-adjusting and comfortable support while floating and one which accommodates various body shapes, sizes and weights.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 1:
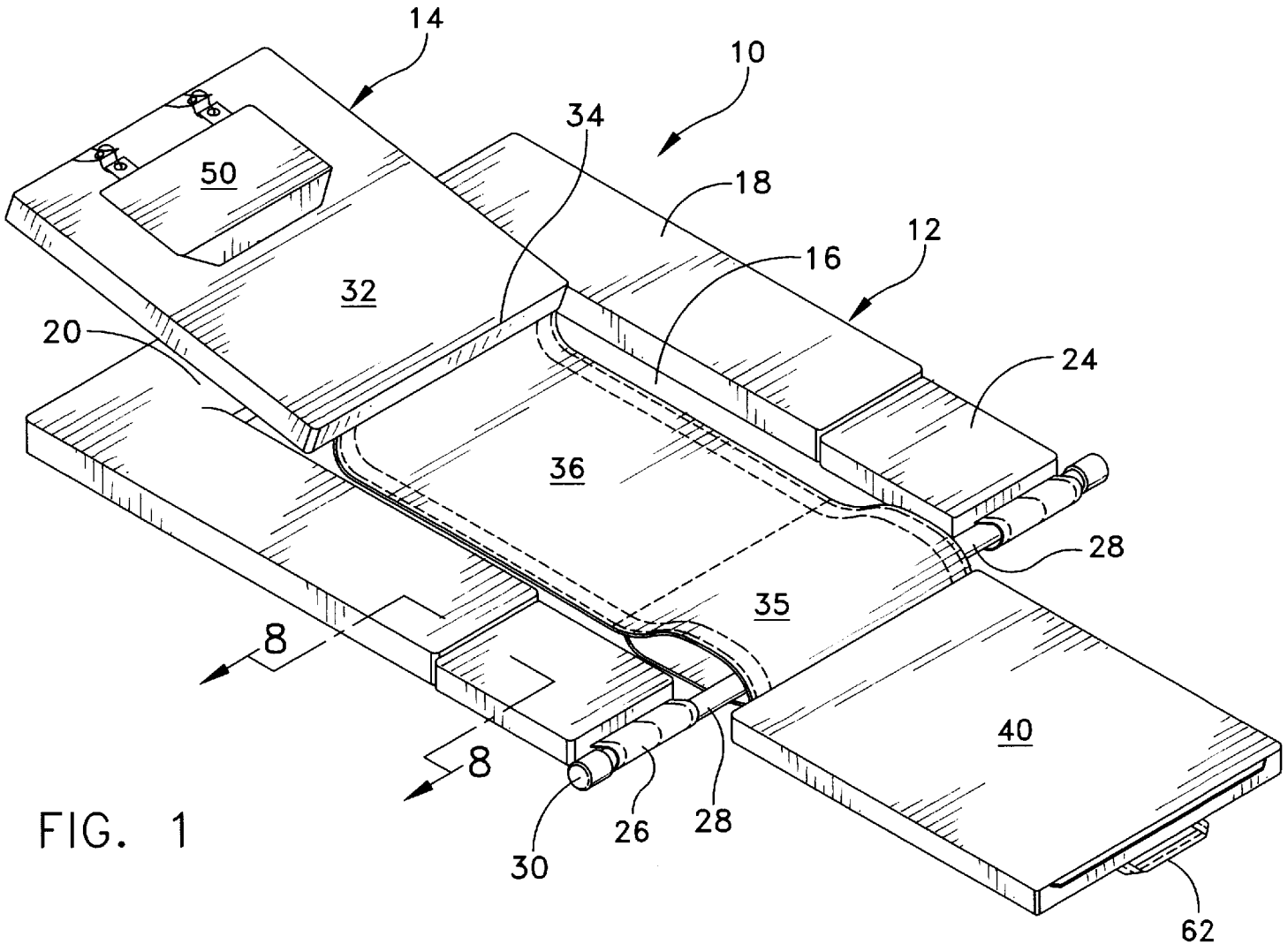
FIG. 1 is a top perspective view showing the major separable components of the present invention in assembled use position.
Figure 2:
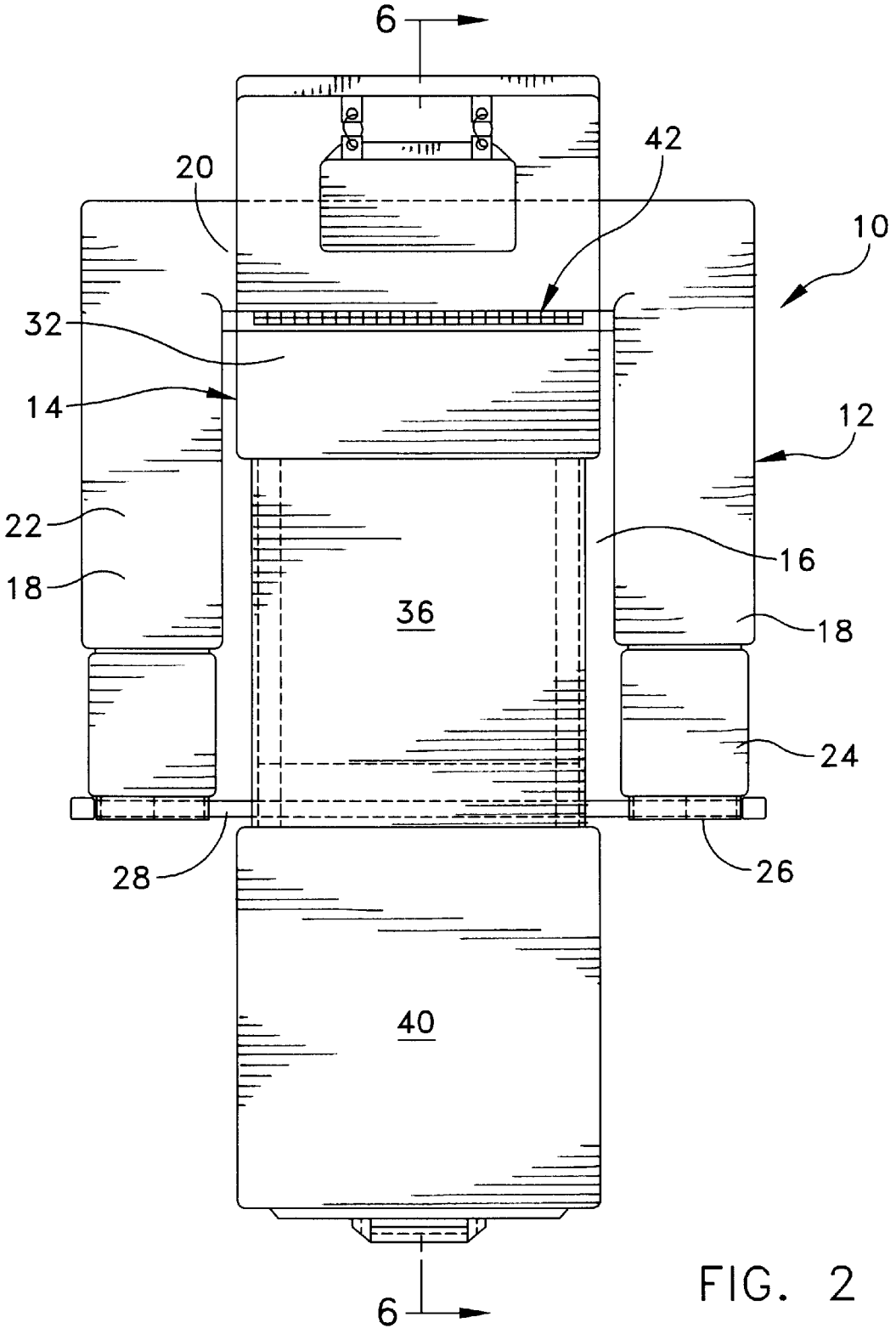
FIG. 2 is a plan view of the chair shown in FIG. 1.
Figure 3:
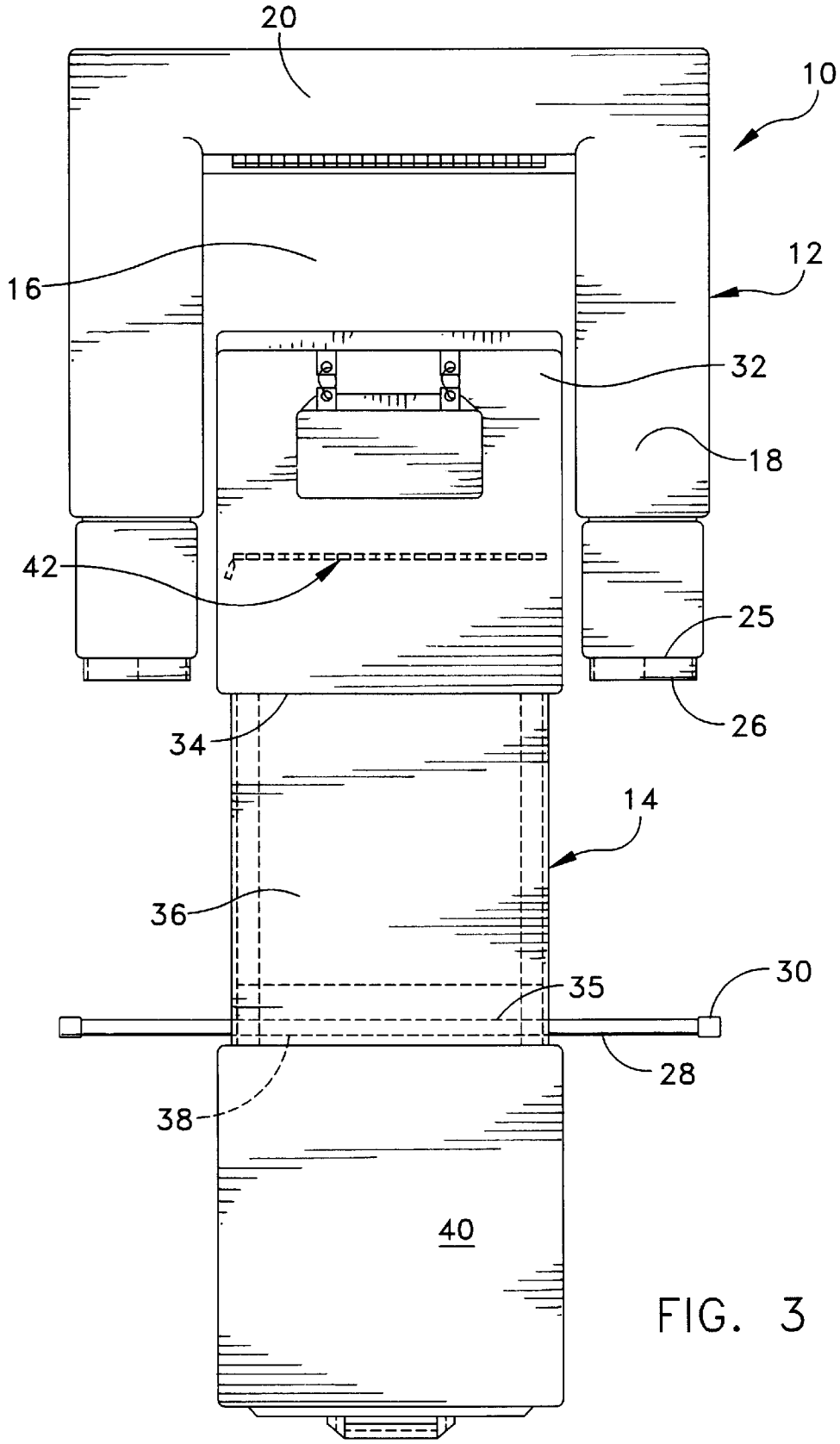
FIG. 3 is a plan view similar to FIG. 2 but showing the major components of the chair in separated position.

Turning now to the drawings and particularly FIGS. 1 through 3 thereof, the floating chair construction 10 of the present invention is best depicted. Such chair 10 comprises two major separable components, namely, a generally U-shaped float 12 and a longitudinally oriented primary body supporting portion 14 adapted for pivotal connection within the float as will hereinafter be more fully brought out. Such float portion includes a pair of longitudinally extending, laterally separated arms 18 connected at one end by a lateral connector or base wall 20. The float 12 thus defines an interior longitudinally oriented opening 16 in which the primary supporting is portion 14 is disposed and connected thereto at a pair of longitudinally separated locations—one at the connector 20 and the other at the arms 18.

The float portion 12 is preferably formed from a closed cell resinous foam composition which is capable of floating on water and does not readily absorb water because of its closed cell construction. Such foam material in the form of separate pieces inserted within a cover 22 formed from a fabric such as a strong wear resistant, water shedding canvas material so as to form the float portion 12. This results in the preferable overall flexible but somewhat stiff character of the float portion such that it bonds and deflects when pushed on yet maintains its overall shape. It should be pointed out that the canvas cover material, in effect, forms an envelope for the receipt of the foam material and furthermore provides a surface on which connections and attachment means may be readily provided as will hereinafter be more fully brought out.

Figure 8A:
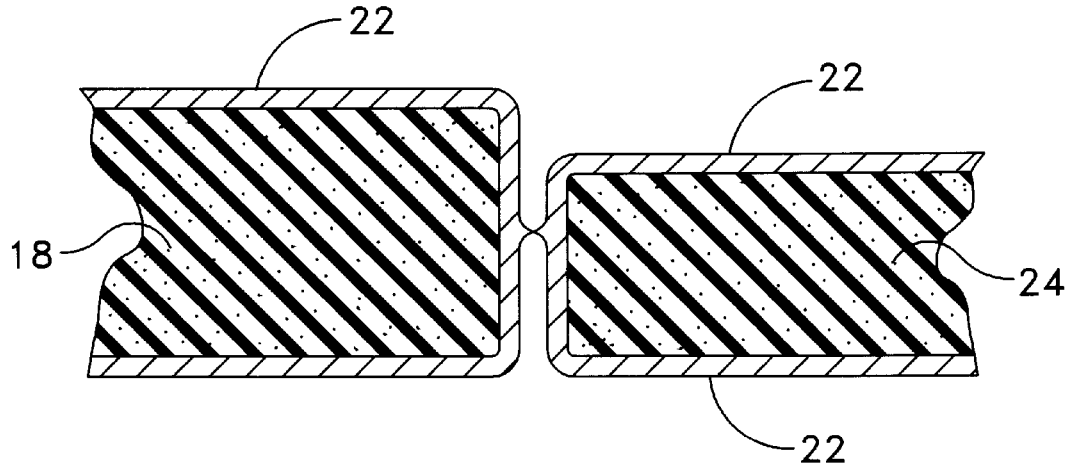
FIG. 8*a* is an alternate embodiment of the structure shown in FIG. 8.
Figure 8:
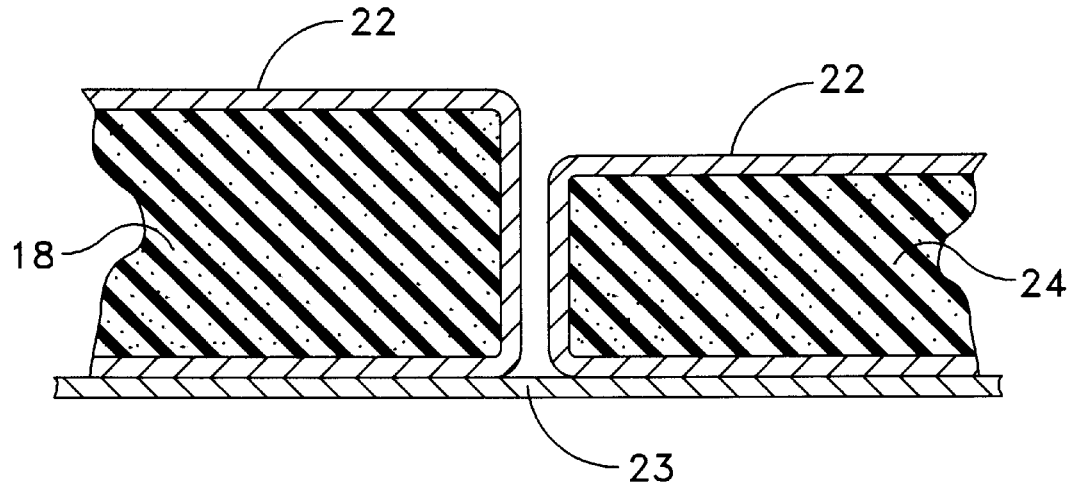
FIG. 8 is a sectional view on an enlarged scale taken along the line 8—8 of FIG. 1.

The forward portion of the U-shaped float 12 includes arm extensions 24 pivotally connected to the forward terminals of the arms 18 by either a double thickness of the fabric envelope 22 as shown by FIG. 8*a* or by a reinforcing layer 23 of material such as plastic reinforced fabric which may be applied to the lower surface of the arms 18 and, in effect, spans the connection between the arms 18 and their extensions 24 as shown in FIG. 8. Either of the above embodiments thus inherently form a pivotal connection with the arms, that is, the arm extensions 24 may pivot relative to the arms 18 by such connection. In addition, the forward termini 25 of the arm extensions 24 are each provided with a fabric pocket 26 adapted to receive a pivot pole 28 preferably formed from plastic, wood, nylon or the like and is adapted to laterally extend across the opening 16 and through an open primary pocket 35 provided in the body supporting portion 14 so as to serve as a part of the means by which the two major portions 12 and 14 are connected. The pole is provided with opposed ends 30 in turn adapted for receipt in the pockets 26.

Figure 4:
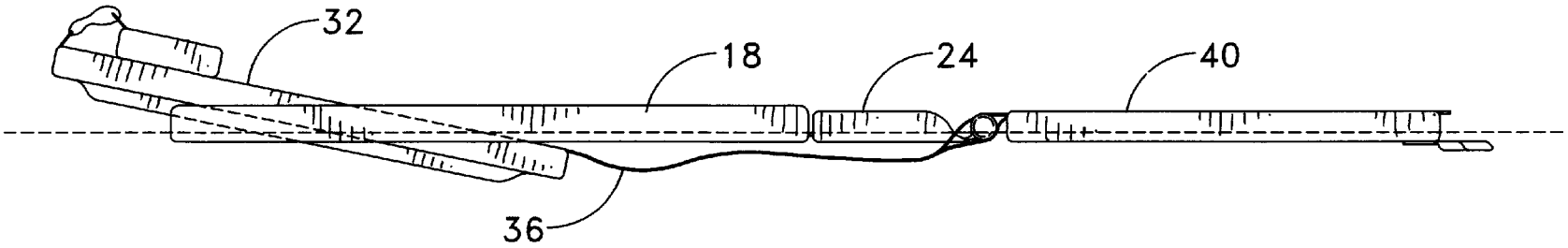
FIG. 4 is a side view of the chair assembly shown floating on the water surface.

The primary body supporting portion 14 of the device is longitudinally oriented and of a length suitable to adequately support a person's body when lying prone thereon and generally facing in an upward position. Such portion, as best shown in the transition between FIGS. 2 and 3, is adapted to extend longitudinally with respect to the U-shaped float portion 12 and laterally within the confines of the opening 16, that is, between the laterally separated arms 18 and the extensions 24 thereof. The body support portion 14 in turn is formed by an upper backrest portion 32 connected at its front edge 34 with a sling or central support section 36 made solely from canvas or some other flexible material with little or no buoyant effect and which in turn is provided at its forward edge 38 with a foot supporting platform or section 40. The back supporting section 32 and the foot supporting section 40 are formed from blocks of foam material covered with a canvas fabric as is the float portion 12 and in combination form the means by which the body is supported in a floating condition within the float as best shown in the transition between FIGS. 4 and 5 of the drawings.

The primary body supporting portion 14 is connected to the float portion 12 by means of the connecting pole 28 which extends through a laterally extending open primary pocket 35 provided at the forward edge 38 of the middle sling portion 36, and in this manner the foot supporting portion 40 as well as the sling portion 36, in effect, are pivotally connected to the float portion 12. In this regard, it should be pointed out that such envelope or pocket 35 is positioned to roughly correspond to that portion of the human body in the vicinity of the back of one's knees when an upward facing prone position normally associated with sitting is assumed by the user within the chair of the present invention. Also instead of utilizing a single primary pocket 35 as depicted, a series of laterally separated straps (not shown) could be utilized.

Figure 5:
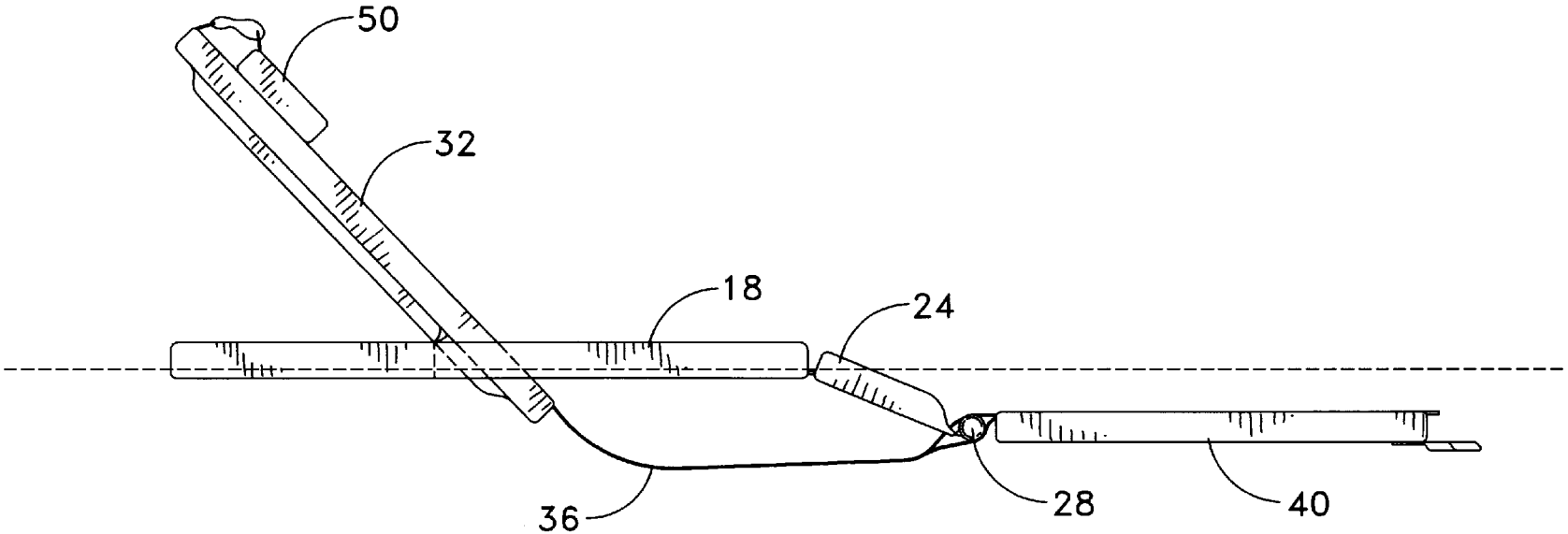
FIG. 5 is a view similar to FIG. 4 but showing the relative positions of the various chair components when a user has assumed a sitting position therein while the device is floating on the surface of water.
Figure 6:
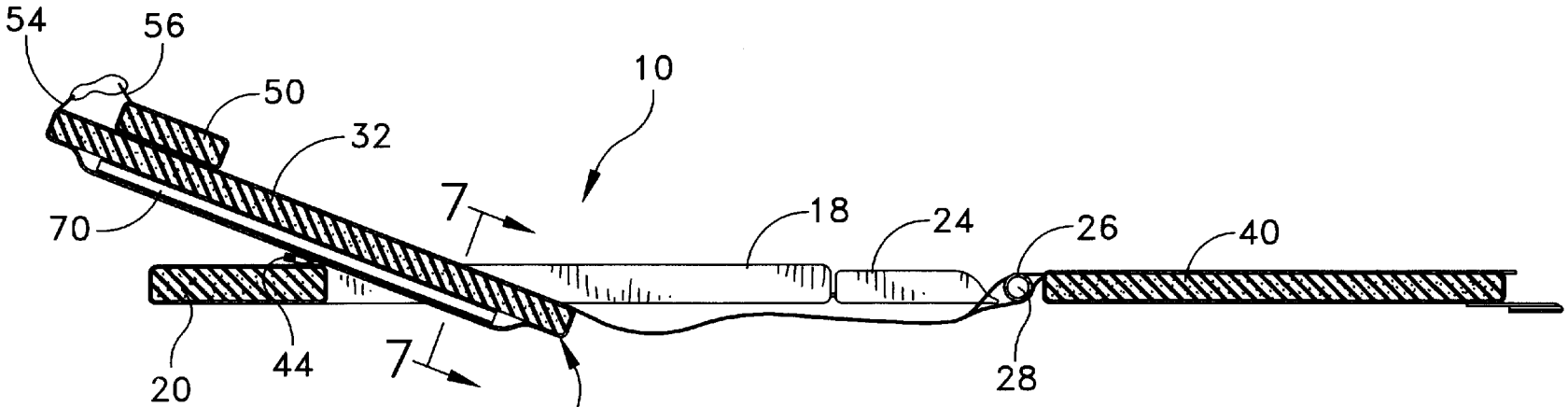
FIG. 6 is a side sectional view of the device taken along the line 6—6 of FIG. 2.

In addition, the body support portion 14 may be additionally attached and preferably pivotally so attached by a connection means 42 provided in the rear of the backrest portion 32 and assembled with an associated connector portion 44 laterally extending across the upper surface of the base wall 20. Such connecting means 42 could be a cooperating zipper as depicted or could be associated hook and loop sections of a Velcro® connection or the use of rows of grommets on both the backrest and the connector member 20 which are then interlaced with a cord to join them—it being clear that whichever form of connection 42 is utilized that a degree of relative pivotal motion between the backrest 32 and the float portion 12 is facilitated such that the back portion 32 can assume an elevated angular position with respect to the float 12 when the person is sitting therein as shown in FIG. 5 of the drawings. In addition, the backrest 32 may be provided with a headrest 50 attachable thereto as by the provision of cooperating hook and loop fasteners both on the headrest and the upper portion of the upper surface of the backrest or as shown specifically by the drawings by a headrest 50 that is connected to the upper end of the backrest by a pair of longitudinally extending straps 54 to a similar pair of straps 56 on the headrest itself and connecting means in the form of rope or other strand tying such straps together.

As should be clear by the above description, the primary body support 14 incorporating the various combination of connecting and articulating points provided and above described has the ability to assume a configuration corresponding to a natural sitting position of a person using the float. Also, the above-described articulation of the device at the forward edge of the backrest and the upper edge of the footrest contributes to such effect, that is, the canvas sling portion 36 and its connection between the backrest and footrest portions of the primary body support portions 14 enables a curved attitude to be assumed for that portion of the body support portion 17 that receives the user's buttocks and thighs so as to contribute to a relaxed hammock-type support configuration without the need for a great deal of adjustability within the sling seat structure. In addition, the ability of the arm extensions 24 to downwardly pivot about their connection with the forward edges of the arms 18 themselves enables the pivot pole to submerge when in a use position depending, of course, upon the weight of the user. These effects contribute to the comfort, flexibility and usefulness of the present device. Also, the ability of the primary support portion 14 to move relative to the float portion 12 and the non-buoyancy of the sling portion all contribute to the ability of the chair of the present device to enable the user to more easily achieve a sitting position therein. In effect, the above discussed component parts and the relationship and the manner in which they can move relative to each other in the floating position also enables the user to climb into the chair without or at least with reduced likelihood of upending or overturning the entire device as is the case with many prior art devices especially the inflatable type devices. The overall flexible nature of the float portion also enables such to bend and generally facilitates climbing on and mounting the chair from the water as contrasted to totally rigid structures of the prior art. The lateral hinge points of the device also enable the device to be conveniently folded for transport and storage.

Figure 7:
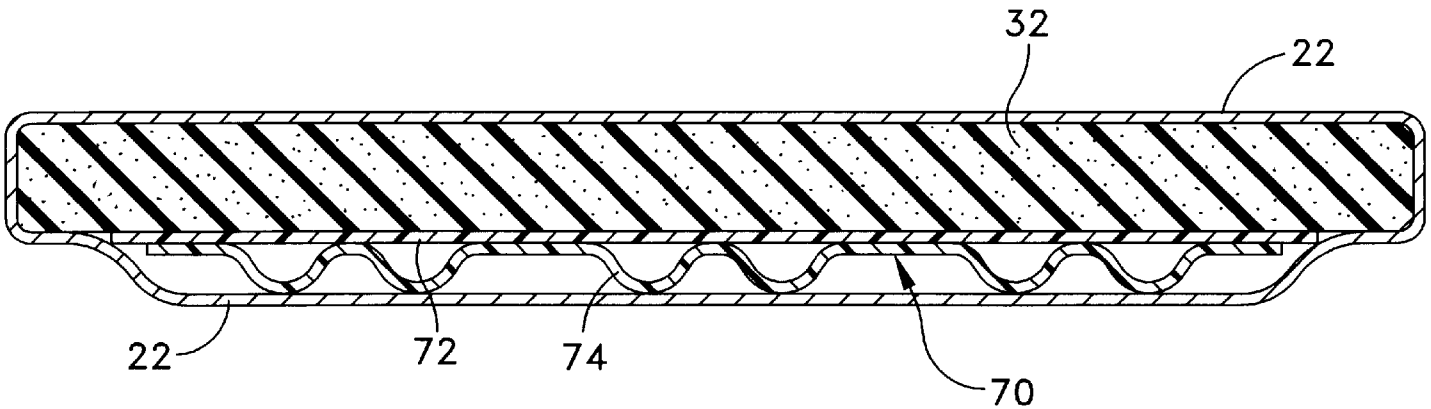
FIG. 7 is a sectional view on an enlarged scale taken along the line 7—7 of FIG. 6.

Turning now to FIG. 7 of the drawings, it should be pointed out that the backrest 32 may be provided with stiffening means 70. As shown by FIG. 7, such stiffening means takes the form of a plastic base sheet 72 to which a second sheet 74 having a series of longitudinally oriented waves or convolutions is attached either by heat sealing, sewing or the like of the two layers or sheets together. The composite stiffener 70 is then inserted between the foam block and the canvas shell or envelope 22. In addition to such stiffener 70, other stiffeners may be utilized such as a corrugated board shaped to conform generally to the shape of the backrest 32 assuming, of course, that such board is formed from non-absorbent, water repellent materials such as plastic and the like.

As may thus be apparent, the device of the present invention accomplishes its use objectives in a straightforward manner so as to present a chair which is comfortable and safe to use and which enables easy access and exit to and from respectively while in the use, that is, floating, position.

Figure 12:
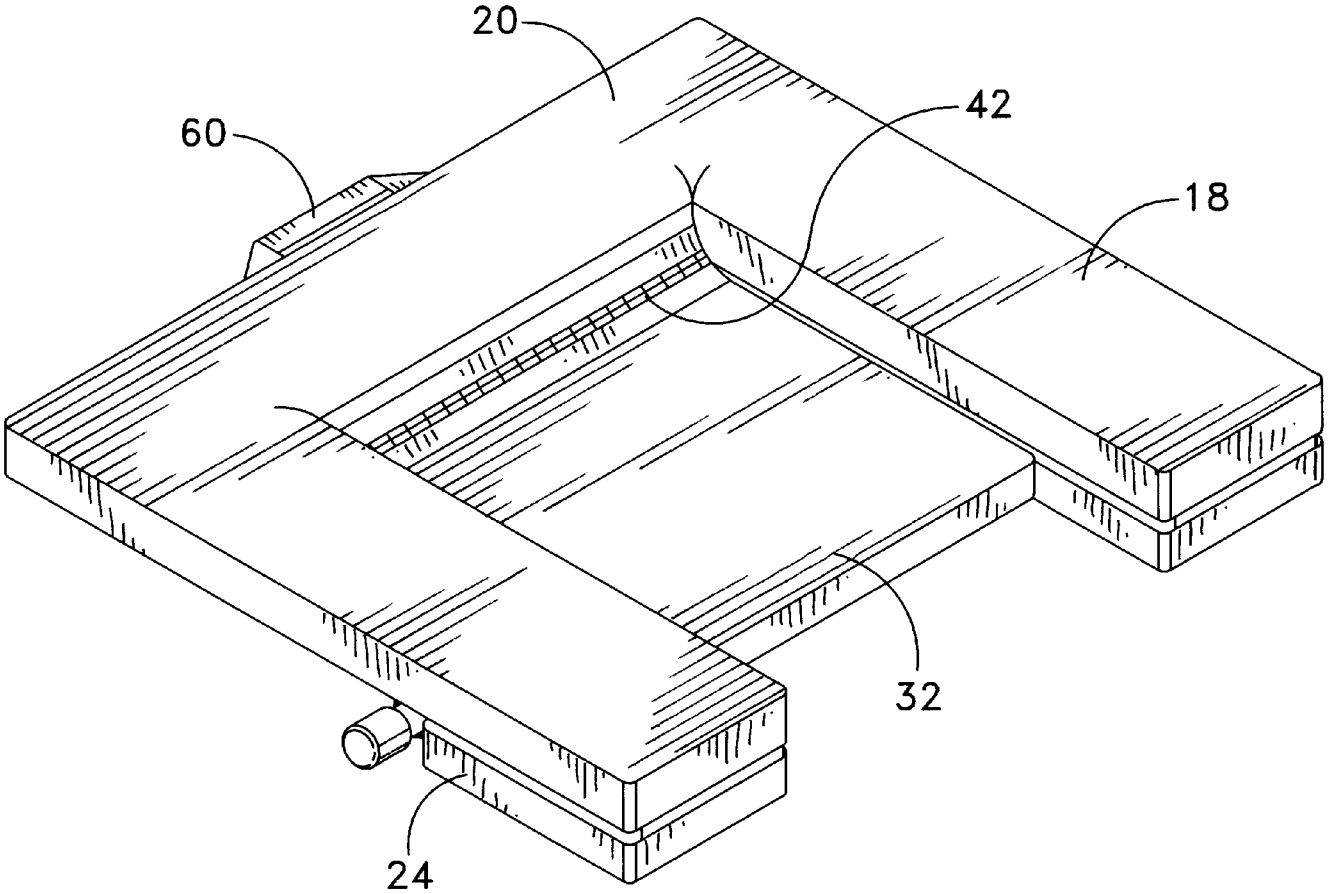
FIG. 12 is a view similar to FIG. 11 but showing the final folded position of the device.
Figure 13:
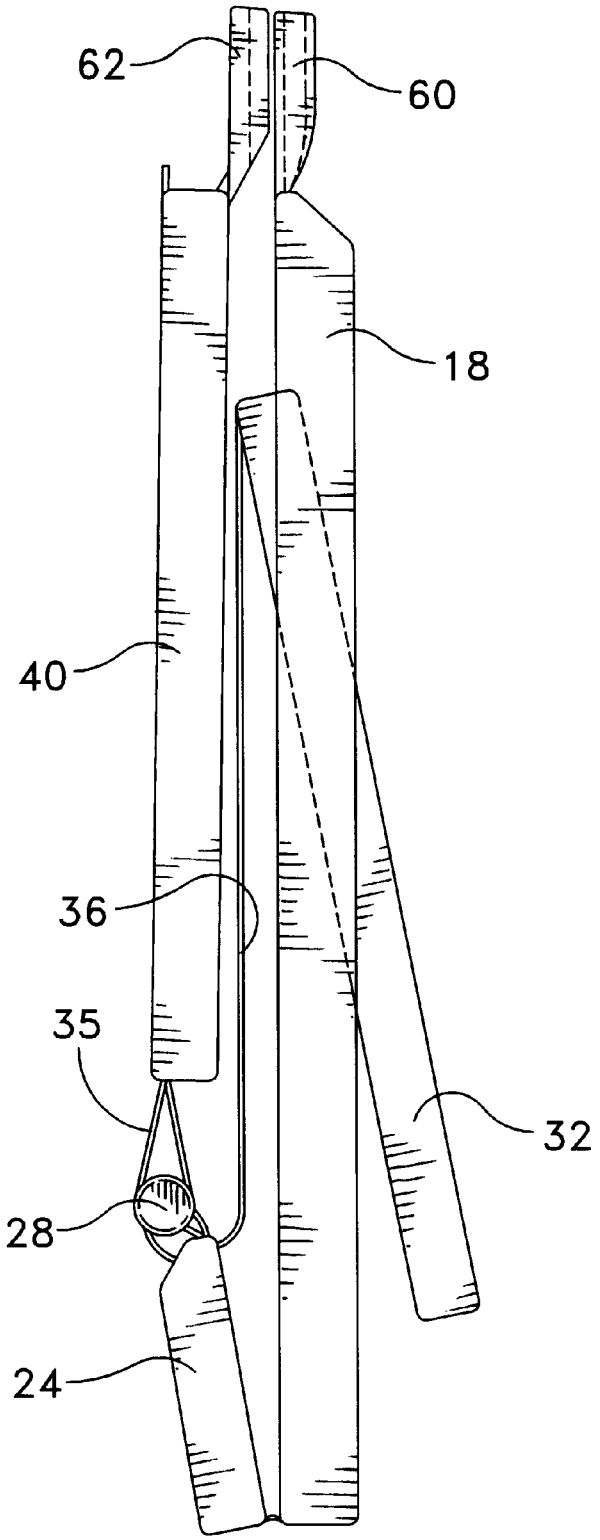
FIG. 13 is a left end elevational view of FIG. 12.

In addition to the above as will hereinafter be more fully apparent, the device not only accomplishes such aforementioned objectives but is further dimensioned and constructed so as to be able to be positioned and folded so as to present a convenient and compact space-saving package when not in use and for transport either by itself or within a carrier such as a pouch or bag. To further such objectives, the device is provided with a pair of separate holding straps 60, 62 preferably formed from canvas or the like and sewn to the fabric envelope 22 or otherwise connected thereto. First holding strap 60 is attached to the upper edge of the lateral connector or base wall 20 of the float 12 and the second strap 62 positioned at the opposite end of the device, that is, at the forward portion of the lower or foot supporting section 40. When the device is appropriately folded and otherwise manipulated such that the two handles or straps 60 and 62 face each other in adjacent positions such that one can place his or hand through both of the straps, it will be apparent that such forms a convenient mechanism by which the device may be carried from place to place or used to manipulate the device into a storage bag or the like. Such relative positioning and above described relation is best shown in FIGS. 12 and 13 of the drawings. As will be hereinafter explained, the procedures by which the device may be manipulated and folded from the position as shown in FIG. 9 to that position shown in FIGS. 12 and 13 will be set forth.

Initially, it should be pointed out that for practical considerations the compactness of the resultant folded packaging of the device is limited to the extent of the longest unfoldable length, that is, the length of the float arms 18. With such in mind, the arm extensions 24 have been designed not only to make the seating position more comfortable while using the device in a seated position, but also the length of the arm extensions 24 are dimensioned such that their length plus the length of the foot support section 40 generally approximates the length of the longest component, that is, the float arms 18, such that when the device is folded along the hinged connection between the arms 18 and the arm extensions 24 and inwardly disposed such that their rear or under surface is face to face with the back of the surface of the arms 18 and the footrest portion 40 similarly positioned with respect to the lateral connector or base wall 20 of the float 12, then the resultant folded package will be essentially no longer than the length of the arms 18.

Figure 9:
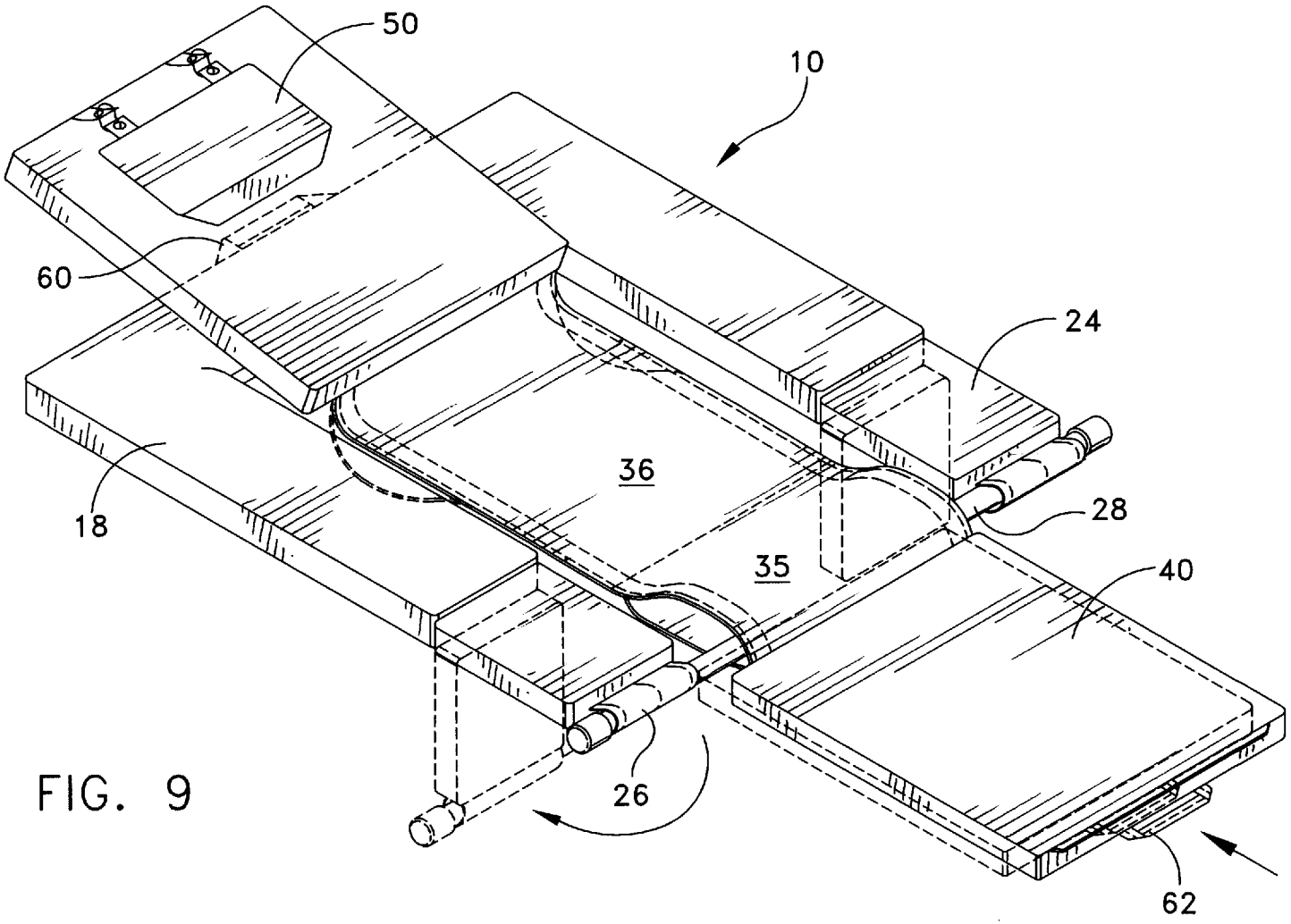
FIG. 9 is a view similar to FIG. 1 but showing the first stop in folding the device for storage from a supported position as shown by the solid lines, the dotted lines showing a transitional position of the device between folding steps.
Figure 10:
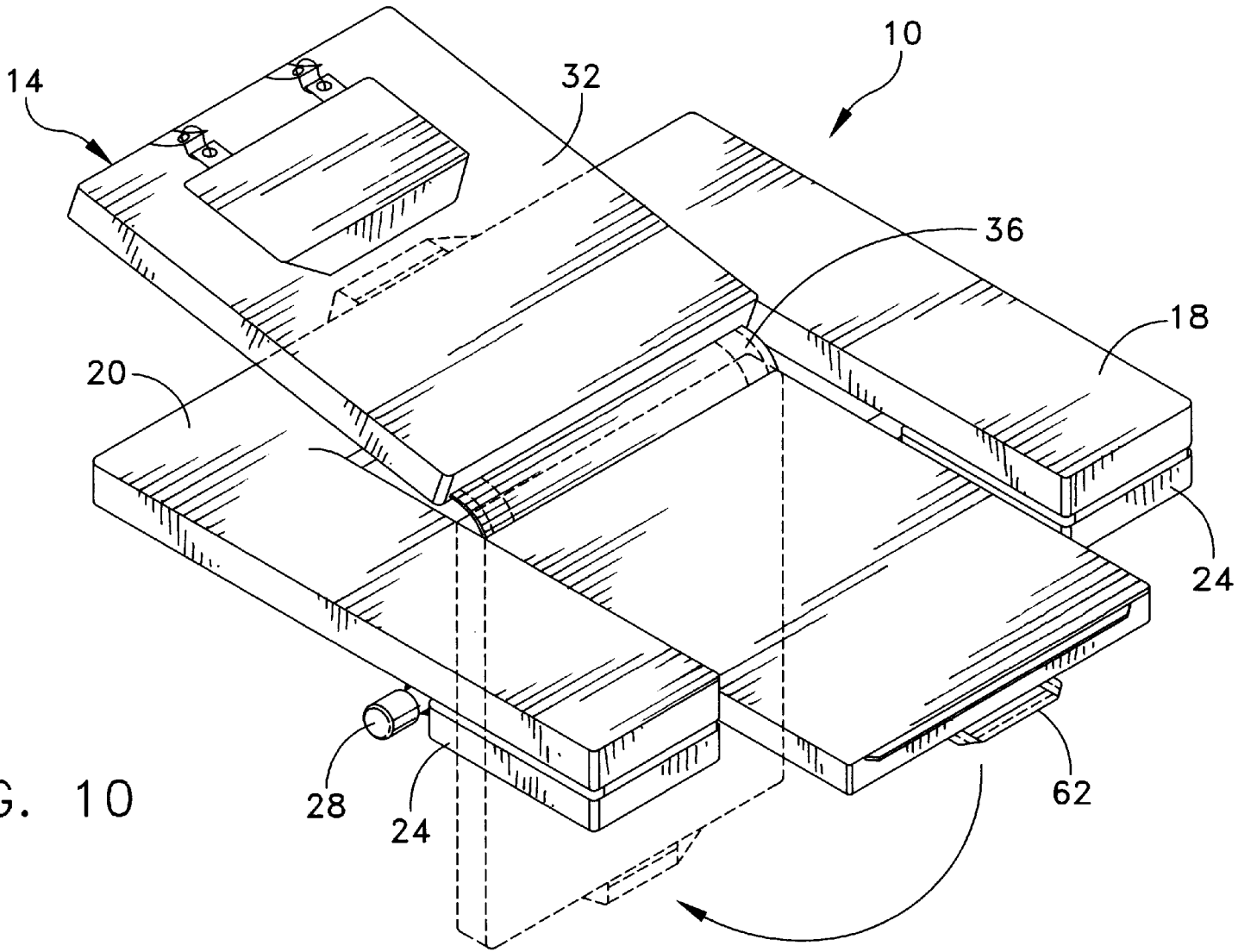
FIG. 10 is a view similar to FIG. 9 but showing the next progressive folding step.
Figure 11:
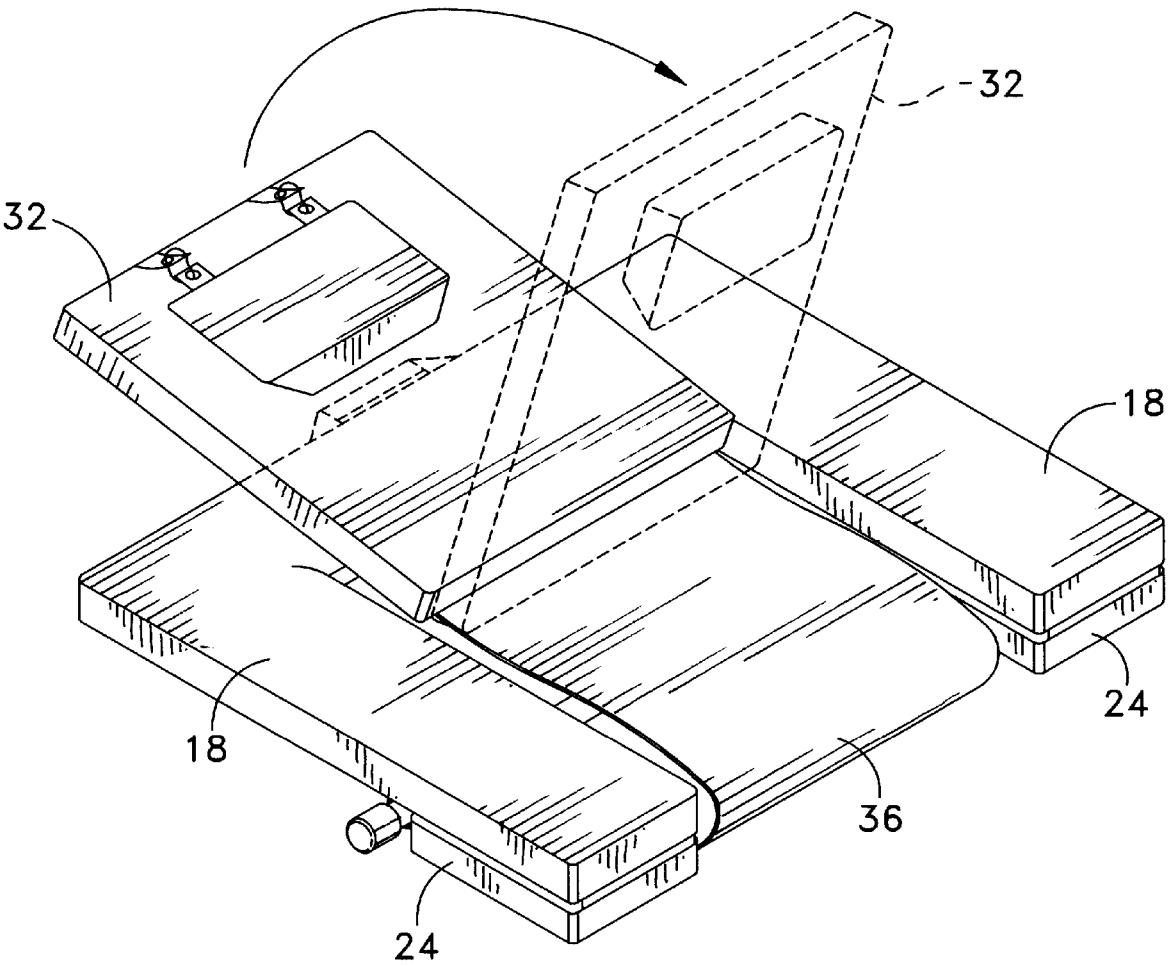
FIG. 11 is a view similar to FIG. 10 but showing the next progressive folding step.

In order to achieve such positioning as in FIGS. 12 and 13, the initial step in the process is depicted in FIG. 9 wherein the arm extensions 24 are pivoted downwardly and inwardly as shown by the direction of the arrow and from the intermediate position shown in the dotted lines to the fully folded position shown in FIG. 10. At the same time, the pivot pole 28 by reason of its connection at opposite ends to the arm extensions via the pockets 26 similarly moves downwardly and then forwardly so as to be positioned as shown in FIG. 10. Such movement of the pivot pole is accompanied by the upward movement of the foot section 40 connected thereto by means of the primary pocket 35 to the position shown in FIG. 10. Thereafter, the footrest section 40 is downwardly and then upwardly pivoted as shown by the arrow in FIG. 10 so as to assume a position underneath the arms 18 and more specifically such that its handle 62 is positioned adjacent the handle 60, that is, the forward lowermost portion of the footrest section 40 is positioned, so as to be directly under and aligned with the lateral connector or base wall 20. It should be pointed out that the footrest section 40 in FIGS. 11 and 12 is to some extent obscured by, that is, it underlies, the sling portion 36. Thereafter, the upper backrest portion 32 is forwardly and then downwardly pivoted as shown by the arrow in FIG. 11 such that it is positioned between the arms 18 as shown by FIG. 12.

It will thus be apparent by reference to FIGS. 12 and 13, that the folded device presents a convenient package for transport and one in which the overall bulk of the device is reduced to a large but manageable extent and one that is no greater than twice the thickness of the arms 18 assuming all the other major components are of a similar thickness. In such position as shown in FIG. 13, it should also be apparent that the body supporting sling portion 36 is disposed between the backrest 32 and the footrest 40 while the backrest, as previously indicated, is positioned laterally between the arms 18. It will thus be apparent that not only is a compact conveniently handled package achieved by folding the device in the above explained manner, but also that it is unnecessary to disassemble or otherwise remove either the pivot pole or other parts of the device except the headrest 50, if desired, before such procedure, and that the convenient placement of the handles not only assist in the device being manipulated but is particularly convenient so that the thus folded device can be disposed into an open ended bag when it is desired to store the device or when carrying the device long distances or otherwise more conveniently manipulated, although it should be pointed out in this regard that carrying the device as previously mentioned without such an outer bag or container is decidedly convenient and also enables items normally associated with the swimming pool or beach to be inserted within the various folds and pockets provided in the folded format as will be quite evident by reference to FIG. 13.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A floating chair assembly comprising a substantially U-shaped float portion having a pair of longitudinally extending laterally spaced arms having rear and forward ends and connected at their rear ends by a laterally extending base wall so as to define a longitudinally oriented opening between said arms and a longitudinally oriented primary body support portion flexibly and articulatively mounted at least partially within said opening, said primary body support pivotally connected to said float portion at first and second longitudinally separated connections, said first connection being at said base wall and said second connection being at the forward ends of said float arms, said primary body support portion including a central sling portion formed of flexible material and adapted to contact and support middle sections of a human occupying the chair, wherein said second connection between the float and primary body support portions comprises a rigid laterally extending pole having opposed ends in turn fastened to the forward ends of said arms and in turn centrally extending across said longitudinally oriented float portion opening and through a pocket formed at the forward terminal end of said central sling portion, said float portion arms including arm extensions having forward and rear ends pivotally attached to said arm forward ends, said pole attached to said arm extension forward ends.

2. A floating chair assembly comprising a substantially U-shaped float portion having a pair of longitudinally extending laterally spaced arms having rear and forward ends and connected at their rear ends by a laterally extending base wall so as to define a longitudinally oriented opening between said arms and a longitudinally oriented primary body support portion flexibly and articulatively mounted at least partially within said opening, said primary body support pivotally connected to said float portion at first and second longitudinally separated connections, said first connection being at said base wall and said second connection being at the forward ends of said float arms, said primary body support portion including a central sling portion formed of flexible material and adapted to contact and support middle sections of a human occupying the chair, wherein said float portion is shape supporting yet flexible and includes a buoyant foam core having a fabric covering thereover, wherein said float portion arms including arm extensions having forward and rear ends with the rear ends thereof pivotally attached to said arm forward ends, said second connection between the float and primary body support portions comprising a rigid laterally extending pole having opposed ends in turn fastened to the forward ends of said arm extensions, said fabric covering extending across both said arms and said arm extensions and forming the pivotal connection therebetween.

3. The method of folding a floating chair assembly to a flat storage position, said floating chair assembly comprising a substantially U-shaped float portion having planar opposed upper and lower surfaces and having a pair of longitudinally extending laterally spaced arms having rear and forward ends and connected at their rear ends by a laterally extending base wall so as to define a longitudinally oriented opening between said arms and a longitudinally oriented primary body support portion flexibly and articulatively mounted at least partially within said opening, said primary body support pivotally connected to said float portion at first and second longitudinally separated connections, said first connection being at said base wall and said second connection being at the forward ends of said float arms, said primary body support portion including a central sling portion formed of flexible material and adapted to contact and support middle sections of a human occupying the chair, said primary body support portion including an upper backrest portion having forward and rear edges with the forward edge thereof connected to the rear end of said sling portion, said backrest portion being buoyant and having planar opposed upper and lower surfaces, said primary body support portion further including a lower footrest portion having forward and rear edges with the rear edge thereof pivotally connected to the forward end of said sling portion, said footrest portion being buoyant and having opposed planar upper and lower surfaces, said method comprising initially downwardly inwardly pivotally folding said footrest portion with respect to said float portion so as to position the footrest portion underneath the float portion, thereafter pivotally folding said headrest portion forwardly downwardly inwardly to a position wherein the headrest rear edge is positioned forwardly between said float arms partially within said float opening and the headrest forward edge is positioned between said footrest and said float portion base wall, wherein said second connection between the float and primary body support portions of said floating chair assembly further comprises a rigid laterally extending pole having opposed ends in turn fastened to the forward ends of said arms and in turn centrally extending across said longitudinally oriented float portion opening and through a pocket formed at the forward terminal end of said central sling portion, said float portion arms including arm extensions having forward and rear ends pivotally attached to said arm forward ends, said pole attached to said arm extension forward ends, said method comprising downwardly inwardly folding said arm extensions with respect to said arms so as to position said arm extensions and said pole beneath said arms prior to downwardly pivotally folding said footrest portion.

* * * * *